United States Patent [19]

Schaier

[11] Patent Number: 4,887,933

[45] Date of Patent: Dec. 19, 1989

[54] DRAIN PIPE SHIELD

[76] Inventor: Warren Schaier, 40 Meadowbrook Dr., Wrentham, Mass. 02093

[21] Appl. No.: 363,385

[22] Filed: Jun. 5, 1989

Related U.S. Application Data

[63] Continuation of Ser. No. 205,677, Jun. 13, 1988, abandoned.

[51] Int. Cl.[4] ..... E02D 29/12

[52] U.S. Cl. ..... 405/36; 405/52; 405/127; 52/21

[58] Field of Search ..... 405/127, 125, 126, 52, 405/36; 210/163, 154, 164; 239/552, 461; 110/310; 98/44; 52/20, 21; 137/363

[56] References Cited

U.S. PATENT DOCUMENTS

| | | | |
|---|---|---|---|
| 1,127,510 | 2/1915 | Poppenhusen | 210/163 X |
| 1,551,108 | 8/1925 | Lee | 160/DIG. 4 X |
| 1,693,977 | 12/1928 | Egan | 210/163 |
| 2,199,134 | 4/1940 | Johnson | 160/DIG. 4 X |
| 2,584,650 | 2/1952 | Woodruff | 239/461 X |
| 2,788,635 | 4/1957 | Ford | 239/552 X |
| 2,852,369 | 9/1958 | Eyolfson | 210/163 X |
| 2,970,697 | 2/1961 | Larson et al. | 210/163 |
| 2,994,433 | 8/1961 | Sandin | 210/163 |
| 3,275,249 | 9/1966 | Karoly et al. | 239/552 X |
| 3,881,506 | 5/1975 | Hazen | 405/127 X |
| 4,023,590 | 5/1977 | Harris et al. | 52/21 X |
| 4,658,449 | 4/1987 | Martin | 210/163 X |
| 4,805,920 | 2/1989 | Gavin | 52/21 X |

FOREIGN PATENT DOCUMENTS

| | | | |
|---|---|---|---|
| 0977561 | 11/1982 | U.S.S.R. | 405/127 |

*Primary Examiner*—Dennis L. Taylor

[57] ABSTRACT

A plastic shield which is generally rectangular and convex in shape is inserted into a storm drain to provide protection to a storm drain outlet from cleaning tools. The shield is constructed in two sections and is moveably connected to the storm drain to allow workman easy access to the storm drain outlet.

8 Claims, 1 Drawing Sheet

DRAIN PIPE SHIELD

This is a continuation of co-pending application Ser. No. 205,677, filed on June 13, 1988, now abandoned.

SUMMARY OF THE INVENTION

The invention disclosed herein comprises a shield, manufactured of plastic in two sections, which protects a storm drain outlet pipe. The shield is set down into the storm drain and secured to the storm drain walls. The placement of the shield stops damage caused by mechanical devices inserted into the drain. The placement of the shield also prevents destructive particles from entering the intake area of the storm drain.

BRIEF DESCRIPTION OF THE DRAWINGS

Further details are explained below with the help of the example(s) illustrated in the attached drawings in which.

DESCRIPTION OF THE PREFERRED EMBODIMENT

Figure 1:
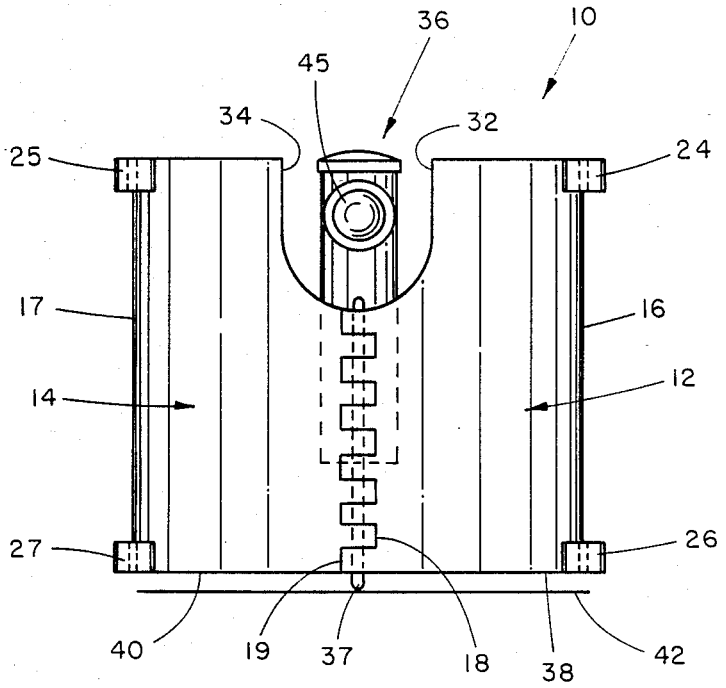
FIG. 1 is a front elevational view of the shield according to the present invention.
Figure 2:
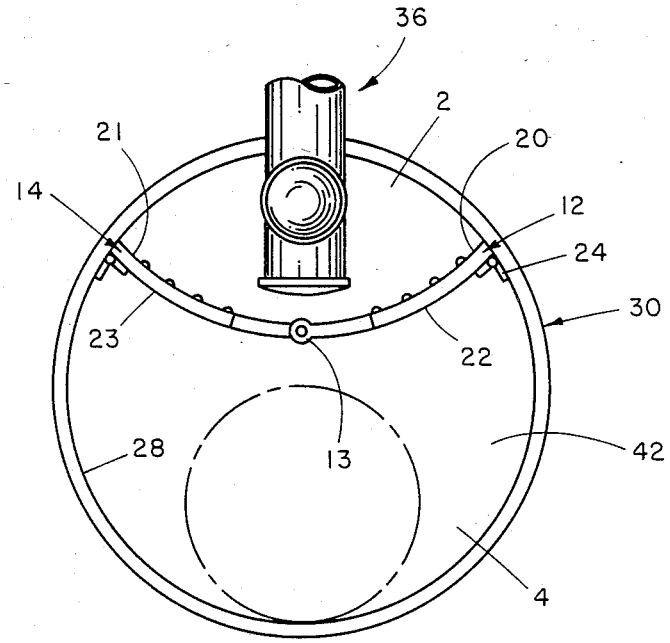
FIG. 2 is a top plan view of the shield shown in FIG. 1 positioned in a storm drain.

There is shown in FIG. 1. a drain pipe shield 10 comprising a first section 12 and a second section 14. The two sections 12 and 14 are generally arched, rectangular in configuration and may be formed of polypropylene or a similar substance. In an engaged position, sections 12 and 14 form a convex shape providing a barrier between an intake area 2 within which an outlet pipe 36 is positioned and a discharge area 4 of a shield 10 protects the outlet pipe 36 from elements such as cleaning clam shells which are inserted into the drain 30. The first section 12 contains a first side edge 16, a second side edge 18, and a fifth side edge 32. The second section 14 includes a third side edge 19, a fourth side edge 17, and a sixth side edge 34. The first and fourth side edges 16 and 17 are in apposed, substantially parallel relation.

The two sections 12 and 14 fit together in a hinged relationship the elements of which are positioned on the second and third side edges 18 and 19 as shown in FIG. 1. The side edges 18 and 19 each are provided with a series of interlocking knuckles. The knuckles are coaxially aligned in a vertical relation. Each knuckle has a through hole 13 through which a pull pin 37 can be placed to hold the sections 12 and 14 in a substantially fixed position. Side edge 32 is in integral angular relationship with side edge 18 and side edge 34 is in integral relation with side edge 19. When the pull pin 37 is engaged the side edges 32 and 34 form a substantially U-shaped configuration allowing access to a first opening 45 without the necessity of opening the shield. This U-shaped configuration allows approximately 98% fluid discharge 4 from the discharge area over the shield to the intake area 2.

The first section 12 has an inner surface 20 and an outer surface 22. The second section 14 has an inner surface 21 and an outer surface 23. The inner surface areas of sections 12 and 14 can be ribbed for added strength. The top edge of the shield 10 and side edge 16 define a first corner. A first pintle hinge 24 is secured to the outer surface 22 adjacent the first corner. The first section 12 and second section 14 contain bottom edges

38 and 40 respectively. A second pintle hinge 26 is secured to the outer surface 22 at a second corner defined by the bottom edge 38 and the side edge 16. A third pintle hinge 25 is secured to a third corner defined by the top edge of the shield 10 and side edge 17. A fourth pintle hinge 27 is secured to a fourth corner defined by the bottom edge 40 and the side edge 17. The pintle hinges 24, 25, 26, and 27 are welded into position on the shield in a manner known in the art.

A continuous wall 28 forms the interior surface of the storm drain 30. The pintle hinges 24 and 26 are aligned and secured to the continuous circumferential wall 28 supporting first section 12 in a right angle relationship with a base portion 42 of the drain 30. The second set of pintle hinges 25 and 27 are aligned and support section 14 in a manner similar to section 12. The pintle hinges 24, 25, 26, and 27 can be attached to the surface 28 by inserting screws or similar fasteners through apertures set in the hinges and into anchors set into the cement of the wall 28.

The pintle hinges 24, 25, 26, 27, may be designed to lock in two positions, the upper position allows the bottom edges 38 and 40 to be positioned approximately 2″ above the base portion 42 of the storm drain 30. When the pintle hinges are set into their lower position the shield rests just above the base portion 42. Single position hinges can also be used, in this embodiment the bottom edges 38 and 40 would rest on the base portion 42. In the case of the single position hinges, because the upper surface of the base portion 42 is irregular, sand and fine grit could wash through openings under the sides 38, 40 into the intake area 2.

It is also possible to have the shield 10 unitary in configuration. Side edges 18 and 19 would be eliminated, along with the need for the pull pin 37 and through hole 13. All other aspects of design would be essentially the same.

In a locked position the drain pipe shield 10 acts as a buffer protecting the outlet pipe 36 from objects entering the discharge area 4 of the storm drain 30. When a maintenance crew is conducting regular maintenance of the drain a mechanical cleaning device or a suction hose is inserted through the top of the drain 30 down into the storm drain chamber to remove grit and debris from the base portion 42. In many instances the mechanical device or hose will swing within the chamber area, if unportected the drain pipe can be severely damaged by blows from the mechanical device. By placing the shield 10 in front of the outlet drain 36, the damage can be averted.

An additional function of the drain pipe shield is as a grit sieve. The action of the water against the shield would allow only a minor amount of smaller particles to pass under or over the shield while keeping large destructive particles in the discharge area 4. These destructive particles of sand and grit can then be removed by the mechanical claw or vacuum.

What I claim is:

1. The combination of a drain pipe shield, a catch basin and an outlet pipe, the catch basin having an inner wall, the drain pipe shield comprising:

(a) a first and a second section; the first section including a first side edge and a second side edge; the second section including a third side edge and a fourth side edge, the second side edge and the third side edges adapted to be hingedly connected together;

(b) a plurality of attachment means being affixed to the first side edge and the fourth side edge of the shield, and each of the attachment means being connected to the inner wall, the first and second sections hingedly attached to the inner wall by the attachment means;

(c) the first and second sections being impermeable;

(d) the outlet pipe opening into the catch basin through the inner wall and being in spaced relation to the drain pipe shield whereby the drain pipe shield protects the outlet pipe.

2. The combination as recited in claim 1 wherein the second side edge and the third side edge are releasably connected; the connecting means being a knuckle joint.

3. The combination as recited in claim 1, wherein the first and second sections being substantially imperforate.

4. the drain pipe shield as recited in claim 1, wherein:

(a) the attachment means comprises numerous pintle hinges.

5. The combination as recited in claim 1, wherein the first and second sections being formed in an acuate configuration.

6. The combination as recited in claim 5, wherein:

(a) the shield having a bottom edge and the catch basin having a base portion, the bottom edge being spaced from and in close proximity to the base portion.

7. The combination as recited in claim 5, wherein:

(a) the drain pipe shield includes an inner and an outer surface; the inner surface having a series of ribs formed thereon.

8. the combination as recited in claim 5, wherein:

(a) the shield having a bottom edge and the catch basin having a base portion, the bottom edge extending to the base portion.

* * * * *